United States Patent [19]

Sue

[11] Patent Number: 5,062,941

[45] Date of Patent: Nov. 5, 1991

[54] ELECTROLYTIC PROCESS FOR STRIPPING A METAL COATING FROM A TITANIUM BASED METAL SUBSTRATE

[75] Inventor: Jiinjen A. Sue, Carmel, Ind.

[73] Assignee: Union Carbide Coatings Service Technology Corporation, Danbury, Conn.

[21] Appl. No.: 600,929

[22] Filed: Oct. 22, 1990

[51] Int. Cl.[5] ..... C25F 5/00

[52] U.S. Cl. ..... 204/146

[58] Field of Search ..... 204/146

[56] References Cited

U.S. PATENT DOCUMENTS

| | | | |
|---|---|---|---|
| 3,151,049 | 9/1964 | Hendry | 204/146 |
| 4,128,463 | 12/1978 | Formanik | 204/146 |
| 4,356,069 | 11/1982 | Cunningham | 204/146 |
| 4,404,074 | 9/1983 | Tomaszewski | 204/146 |
| 4,886,588 | 12/1989 | Curfman | 204/146 |

*Primary Examiner*—T. M. Tufariello

*Attorney, Agent, or Firm*—E. Lieberstein

[57] ABSTRACT

An electrolytic process for stripping a group IVB or VIB metal coating compound from a titanium based metal substrate using an aqueous electrolyte comprising an oxidizing reagent and an acid with a solution pH of less than 4.5.

7 Claims, No Drawings

ELECTROLYTIC PROCESS FOR STRIPPING A METAL COATING FROM A TITANIUM BASED METAL SUBSTRATE

FIELD OF THE INVENTION

This invention relates to an electrolytic process for selectively stripping a metal coating particularly a compound of a group IVB and VIB metal of the periodic table from a base metal of titanium or an alloy of titanium without chemically attacking the base metal.

BACKGROUND OF INVENTION

High performance components in aircraft engine turbomachines such as compressor blades bearings, gears, impellers and diffusers are typically coated with a metal compound of titanium, zirconium, chromium or tungsten to improve their wear characteristics and to provide erosion protection. The engine parts are cast or otherwise molded or machined from superalloys, stainless steels, alloy steels or titanium alloys and represent very expensive precision components. Removal of the coating from the underlying base metal is necessary if a defect is discovered in the coating and/or for restoring worn components. It is essential to remove the protective coating from the base metal without suffering any detrimental attack to the underlying base metal.

To selectively strip a metal compound of the group IVB and VIB metals of the periodic table inclusive of: titanium, zirconium, hafnium, chromium, molybdenum and tungsten from a titanium alloy base metal is particularly difficult due to the similarity in high corrosion resistance of both the base metal and coating.

Electrochemical stripping of a metal coating from a metal substrate is well known and is basically the reverse of electrodeposition. A reverse current stripping process is disclosed in U.S. Pat. No. 4,356,069 for removing coatings of chromium and nickel from zinc, steel, aluminum, brass or copper using an aqueous solution of chromic acid, peroxide, sulfuric acid and water. A reverse current stripping process is also taught in U.S. Pat. No. 4,128,463 for stripping a coating of a metal carbide such as tungsten carbide from a titanium or titanium alloy substrate. The composition of the electrolyte comprises an aqueous solution of chromic acid or a chromate ion producing material and optionally a sulfate ion added as sulfuric acid. A method for electrolytically stripping a metal containing refractory coating from a base metal using a caustic electrolyte is taught in U.S. Pat. No.'s 3,151,049 and 4,886,588 respectively.

None of the prior art processes are suitable for stripping a metal coating compound of a group IVB and VIB metal such as, for example, a titanium or zirconium compound from a base metal of titanium or a titanium alloy without attacking the base metal or leaving unwanted corrosion pits on the surface of the base metal. The electrolytic process of the present invention is particularly suited for stripping a titanium or zirconium compound or any group IVB or VIB metal compound from a base metal of a titanium metal or alloy without chemically attacking the base metal or forming corrosion pits in the base metal surface.

SUMMARY OF THE INVENTION

The present invention provides a method particularly suited for removal of a compound of a group IVB and VIB metal of the periodic table from a base metal of titanium or an alloy of titanium. According to the process of the present invention the base metal is made the anode in an electrolytic cell utilizing as an electrolyte an aqueous solution comprising an oxidizing reagent and an acid at a concentration to provide a solution pH of less than 4.5 and imposing an applied voltage of from about 6 to 40 volts DC at a current density of between 20–700 amperes per square meter over a predetermined time period at a bath temperature of between 50°–70° C. No detrimental attack of the base metal was found to occur and no pitting was observed on the base metal surface.

The concept of the present invention is based upon the use of an oxidizing reagent which causes a reaction with the metal coating compound for forming an oxide with the metal in the metal coating. A layer by layer separation of the newly formed oxide film from the metal coating takes place until the coating is removed without attacking the base metal. The stripping rate is primarily controlled by diffusion of oxygen ions through the coating from the solution. The oxidizing reagent can be any source of oxygen such as air or an oxygen producing compound such as $H_2O_2$.

DETAILED DESCRIPTION OF THE INVENTION AND EXAMPLES

The present invention relates specifically to an electrolytic process for removing a metal coating from a base metal of titanium or a titanium alloy. Although the process should have applicability to any metal coating which would combine with oxygen for forming an oxide it is particularly suited for use in removing a metal coating of a metal compound of a group IVB and VIB metal of the periodic table inclusive of: titanium, zirconium, hafnium, chromium, molybdenum and tungsten. An example of a titanium compound includes titanium nitride, titanium boride and titanium carbide. A typical example of a titanium alloy base metal is Ti-6Al-4V(AMS4928). Any coating method may be used to form a coating on the base metal.

The configuration of the electrolytic cell is standard and is accordingly not shown. The titanium or titanium alloy base metal is supported or suspended within the aqueous electrolyte solution for forming the anode. The cathode may be any suitable conductor inert to the electrolyte preferably a non-magnetic stainless steel. A DC electrical supply (not shown) is connected from the anode to the cathode to form a direct current circuit through the aqueous electrolyte stripping solution with the applied voltage fixed in a range of between 6 to 40 volts, preferably between 8 to 30 volts at a current density of between 20–700 amperes per square meter.

The aqueous electrolyte comprises a source of oxygen as the oxidizing reagent and an acid in a concentration to adjust to pH of the solution to below 4.5 and preferably between 0.5 and 4.5. The source of oxygen can be air which is fed into the solution at a controlled flow rate to provide a desired volume percent of oxygen in solution or may be supplied from an oxygen producing compound which reacts with water to release oxygen such as hydrogen peroxide or another equivalent peroxide source such as, for example, a perborate, peroxydiphosphate, peroxysulfate and the like.

Any acid may be added to control the acidity of the solution and at a concentration to maintain a pH of below 4.5. The preferred acid is an organic carboxyl or carboxyl-hydroxyl group acid such as lactic acid, oxalic acid, tartaric acid, formic acid, propionic acid or citric acid. Alternatively, a diluted inorganic acid may be used such as, for example, acetic acid, nitric acid, HCl or $H_2SO_4$. The preferred pH range is between .5 to 4.5 and the optimum range in between 1 and 3.5.

The temperature of the electrolyte should be held to between 50°-85° C. and preferably between 50°-70° C.

The following examples substantiate the invention:

EXAMPLE I

Ti-6Al-4V and Ti6Al-2Sn-4Zr-2Mo titanium alloy base metal coupons (1.50×25×50 mm) were coated with a 12 μm TiN coating and immersed in an electrolyte of $H_2O$-(0.05-0.75) wt.% citric acid—(2.6-4.3) wt.% $H_2O_2$ in an electrolytic stripping cell. The coated surface of the coupon was surrounded with a cathode ring which was made of electrical conducting material such as stainless steel. Electrical contact from a D.C. powder supply was connected from the coupon as the anode to the cathode ring via alligator clips. The electrolyte had a pH value between 3-3.5 and was agitated and kept at a bath temperature of between 50°-70° C. The power supply was adjusted to provide an electrical potential between 8-25 Vdc across the coupon and the cathode ring. The current density was 20-160 amperes per square meter. After 120 minutes, the coating was completely dissolved into the solution without damage to the underlying base metal of the coupons.

EXAMPLE II

The following table is a compilation of variations in electrolyte, pH and operating conditions using the electrolytic stripping technique as described in Example I for removing a 10 μm ZrN coating from a Ti-6Al-4V compressor blade. The coating was completely removed without any chemical attack to the base metal in one hour.

| | Electrolyte Composition (wt. %) | | | | | | | Conditions | | |
|---|---|---|---|---|---|---|---|---|---|---|
| No. | $H_2O$ | $H_2O_2$ | Lactic Acid | Oxalic Acid | Citric Acid | Tartaric Acid | pH | Applied Voltage (V) | Current Density ($A/m^2$) | Temp. (C.°) |
| A | bal. | 7.5 | 6.4 | — | — | — | 2 | 25 | <240 | 65 |
| B | bal. | 7.5 | — | 1.2 | | | 1.5 | 20 | <400 | 65 |
| C | bal. | 7.5 | — | — | 2.5 | — | 2 | 29 | <320 | 65-70 |
| D | bal. | 7.5-15 | — | — | — | 0.5-3.0 | 0.5-3.5 | 25 | <270 | 65 |

EXAMPLE III

A Ti-b 6Al-4V coupon (1.50×25×50 mm) coated with a 25 μm thick $TiB_2$-Ni coating was immersed into the electrolyte consisting of 6% $H_2O_2$, 1% oxalic acid, and 93% $H_2O$ (in weight percent) with a pH=1.5 at 65° C. for 120 minutes. The stripping set-up was described in Example I. The applied voltage was 6 Vdc and the current density was less than 700 amperes per square meter. The coating was completely removed from the substrate without any damage to it.

EXAMPLE IV

The electrolytic stripping set-up was the same as that in Example I. A solution consisting of water and citric acid up to 10 weight percent with a pH value of 2 was used as an electrolyte. 12 μm TiN and 100 μm WC-Co coated Ti-6Al-4V coupons (1.50×25×50 mm) were immersed into the electrolyte at approximately 60° C.; a $N_2$-20 vol.% $O_2$ gas was introduced into the electrolyte via a gas dispersion tube with a flow rate of $0.11 m^3/hr$. and a 15 Vdc electrical potential was applied between the coated coupon and the cathode ring. The current density was less than 440 amperes per square meter. For approximately 150 and 210 minutes, TiN and WC-Co coatings were removed from the Ti-6Al-4V substrate without any chemical attack to it, respectively.

EXAMPLE V

A TiN coated Ti-6Al-4V impeller was immersed in a solution of 0.3% citric acid, 4.2% $H_2O_2$ and 95.5% water (in weight percent). The electrolyte had a pH=3 and was kept at 60° C. The coating thickness was approximately 10 μm. A 10 Vdc electrical potential was applied between the impeller and the cathode. After 180 minutes, the coaling was completely removed without any chemical attack to the underlying substrate.

EXAMPLE VI

TiN coated Ti-6Al-4 V coupons (1.50×25×50 mm) with a coating thickness of 17 μm were immersed in acid containing electrolytes. An electrical potential of 10-15 Vdc was applied between the cathode and the coated coupon (anode) with a current density up to 320 amperes per square meter at 60° C. Typically, the current density depends on acid concentration, pH value, surface area of the coating, and applied voltage. A $N_2$-20 vol.% $O_2$ gas was supplied through a gas dispersion tube with a pore size of 10-15 μm to facilitate the oxidation process of the coating. The gas flow rate was 0.028 cubic meters per hour. After several hours, the coating was completely removed from the substrate without any chemical attack to it. The results are summarized as following:

| Electrolytes (wt. %) | | | | | Conditions | | Total |
|---|---|---|---|---|---|---|---|
| $H_2O$ | Citric Acid | Oxalic Acid | pH | | Applied Voltage (V) | Current Density ($A/m^2$) | Stripping time (min) |
| bal. | 1 | — | 2.5 | | 10 | <150 | 240 |
| bal. | 0.1 | — | 4.5 | | 15 | <80 | 720 |
| bal. | 3 | — | 1.5-2 | | 15 | <200 | 205 |
| bal. | — | 2 | 1 | | 10 | <320 | 120 |

From the above results it can be concluded that a pH value of 4.5 is the highest pH value for practical application.

EXAMPLE VII

A thermal sprayed chromium carbide coating, $Cr_3C_2$-20 wt. % Nichrome (Nichrome: Ni-20 wt.% Cr) with a coating thickness of 150 μm on a Ti-6Al-4V button (12 mm diameter×2 mm in thickness) was immersed in an electrolyte, consisting of 9 wt. % $H_2O_2$, 1 wt. % oxalic acid and 90 wt. % $H_{20}O$. A 5-10 Vdc electrical potential was applied between the cathode and the coated button at electrolyte temperature of 60°-85° C. The current density varied from 250 to 2200 $A/m^2$. After 300 minutes, the coating was completely removed from the metal substrate without deleterious effect on it.

I claim:

1. A method for electrochemically stripping a metal compound of a metal selected from group IVB or VIB of the periodic table from a base metal of titanium or a titanium alloy in an electrolytic cell which comprises the steps of: immersing said base metal having a coating of said group IVB or VIB metal compound thereon into an electrolyte aqueous solution comprising an oxidizing reagent and an acid, said acid having a concentration so as to maintain a solution pH of less than 4.5, connecting said base metal as the anode of said electrolytic cell and a metallic member inert in said aqueous solution as the cathode, imposing a direct current voltage across said anode and cathode in a range of from about 6 to 40 volts DC at a bath temperature of between about 50° C. to 85° C.

2. A method as defined in claim 1 wherein said oxidizing reagent is a source of oxygen.

3. A method as defined in claim 2 wherein said source of oxygen is air fed into said electrolyte at a controlled rate.

4. A method as defined in claim 2 wherein said source of oxygen is an oxygen producing compound which generates oxygen upon contact with water.

5. A method as defined in claim 4 wherein said source of oxygen is selected from the group consisting of hydrogen peroxide, perborate, peroxydiphosphate and peroxysulfate.

6. A method as defined in claims 2 or 5 wherein said acid is an organic acid selected from the carboxyl group or carboxyl-hydroxyl group of acids.

7. A method as defined in claim 6 wherein said solution pH is adjusted between 1 and 3.5.

* * * * *

UNITED STATES PATENT AND TRADEMARK OFFICE

CERTIFICATE OF CORRECTION

PATENT NO. : 5,062,941

DATED : November 5, 1991

INVENTOR(S) : Jiinjen A. Sue

It is certified that error appears in the above-identified patent and that said Letters Patent is hereby corrected as shown below:

Column 1, line 15, after the word "blades", insert --,--.

Column 3, line 49, "Ti-b 6Al-4V" should read "Ti-6Al-4V".

Column 4, line 14, "coaling" should read "coating".

Column 4, line 65, "$H_{20}O$" should read "$H_2O$".

Signed and Sealed this

Sixth Day of April, 1993

*Attest:*

STEPHEN G. KUNIN

*Attesting Officer*

*Acting Commissioner of Patents and Trademarks*